US006450840B2

(12) United States Patent
Nakamura

(10) Patent No.: US 6,450,840 B2
(45) Date of Patent: Sep. 17, 2002

(54) CONNECTOR WITH INSERTABLE RETAINER

(75) Inventor: Hideto Nakamura, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/874,207

(22) Filed: Jun. 6, 2001

(30) Foreign Application Priority Data

Jun. 23, 2000 (JP) ..... 2000-189794

(51) Int. Cl.[7] ..... H01R 13/514
(52) U.S. Cl. ..... 439/752
(58) Field of Search ..... 439/752, 595, 439/489

(56) References Cited

U.S. PATENT DOCUMENTS 4,946,399 A 8/1990 Kawashima ..... 439/752
5,980,331 A * 11/1999 Matsushita et al. ..... 439/752

* cited by examiner

*Primary Examiner*—Khiem Nguyen
*Assistant Examiner*—Chandrika Prasad
(74) *Attorney, Agent, or Firm*—Banner & Witcoff, Ltd.

(57) ABSTRACT

A connector wherein a half-inserted state of a retainer is detected at a location to the anterior of the retainer, relative to the fitting direction of two connector housings. The retainer is inserted into a terminal housing member of a male housing from an outer side thereof. This retainer has a locking arm provided in a unified manner thereon, the locking arm protruding towards the anterior and posterior. The retainer can be maintained in a semi-retaining position, which is located at the outer side, and a fully-retaining position, which is located at the inner side. A female housing is provided with a groove, the locking arm entering this groove when the retainer is attached to the male housing in the fully-retaining position. A locking protrusion, which is formed within the groove, is capable of engaging with the locking arm. If the two housings are fitted together when the retainer is in a half-inserted state, so that the retainer is located towards the outer side relative to its fully retaining position, the locking arm strikes a side wall which surrounds the groove of the female housing, thereby preventing the two housings from being fitted together.

17 Claims, 14 Drawing Sheets

CONNECTOR WITH INSERTABLE RETAINER

TECHNICAL FIELD

The present invention relates to a connector provided with a retainer.

BACKGROUND OF THE INVENTION

One example of an electrical connector provided with a retainer for maintaining terminal fittings in an unremovable state is described in JP 1-60474. This connector is provided with a female housing which fits into a corresponding male housing. The female housing is provided with cavities into which terminal fittings are inserted. A retainer can be inserted from the side so as to intersect with each of these cavities. The terminal fittings are retained when the retainer has been inserted to a depth whereby an outer face thereof forms an approximately unified face with an outer side face of the female housing.

In the case where the retainer is halted in a half-inserted state (this being to the outer side of a correct position for retaining the terminal fittings) and the two housings are fitted together, the portion of the retainer that protrudes from the outer side face of the female housing strikes against an anterior end of the male housing. This prevents the fitting operation from continuing, and allows one to detect that the retainer is in a half-inserted state.

The terminal fittings which are retained by the retainer have their retained portions located close to the center of the female housing (relative to the lengthwise direction thereof). Consequently, the two housings have reached a location close to the center of their fitting depth at the time when the fitting operation is prevented from continuing. As a result, it may be difficult to separate these two housings once more.

Moreover, the male housing is provided with a hood which fits with the female housing, and a terminal housing member for housing male terminal fittings is provided to the posterior of the hood. The retainer is attached to this terminal housing member.

Since the terminal housing member is located to the posterior of the hood which fits with the female housing, the retainer is located in a position which does not interfere with the female housing. Consequently, the half-inserted state of this retainer cannot easily be detected.

The present invention has taken the above problem into consideration, and aims to present a connector wherein the half-inserted state of the retainer is detected at a location to the anterior of the retainer, relative to the fitting direction of the two connector housings.

SUMMARY OF THE INVENTION

According to the invention there is provided a connector comprising two connector housings engageable along a fitting direction, to a fully fitted condition, said connector housings having respective terminals therein, and a retainer insertable in one of said housings at right angles to said fitting direction to a final position whereby terminals in said one housing are retained, characterized in that said retainer includes a projection extending in the fitting direction towards the other housing, and said other housing having a regulating member for contact with said projection and adapted to prevent movement of said housings to the fully fitted condition in the event that said retainer is not in the final position. Such a projection ensures that full engagement of said housings is prevented at a small insertion depth; accordingly separation of the connectors is facilitated.

Preferably the projection passes to the side of the regulating member as the housings are fully inserted, and thus prevents subsequent removal of the retainer until the housings are separated.

The regulating member may be a channel or a projection. The projection is preferably exterior to said one housing.

In a preferred embodiment the projection is also a latching arm engageable with the other housing to maintain said housings in the fully fitted condition. Thus the retainer can provide a dual function, and permit said one housing to be latchable or non-latchable, as required.

BRIEF DESCRIPTION OF THE DRAWINGS

Other features of the invention will be apparent from the following description of preferred embodiments shown by way of example only in the accompanying drawings in which.

DESCRIPTION OF THE EMBODIMENT

Figure 1:
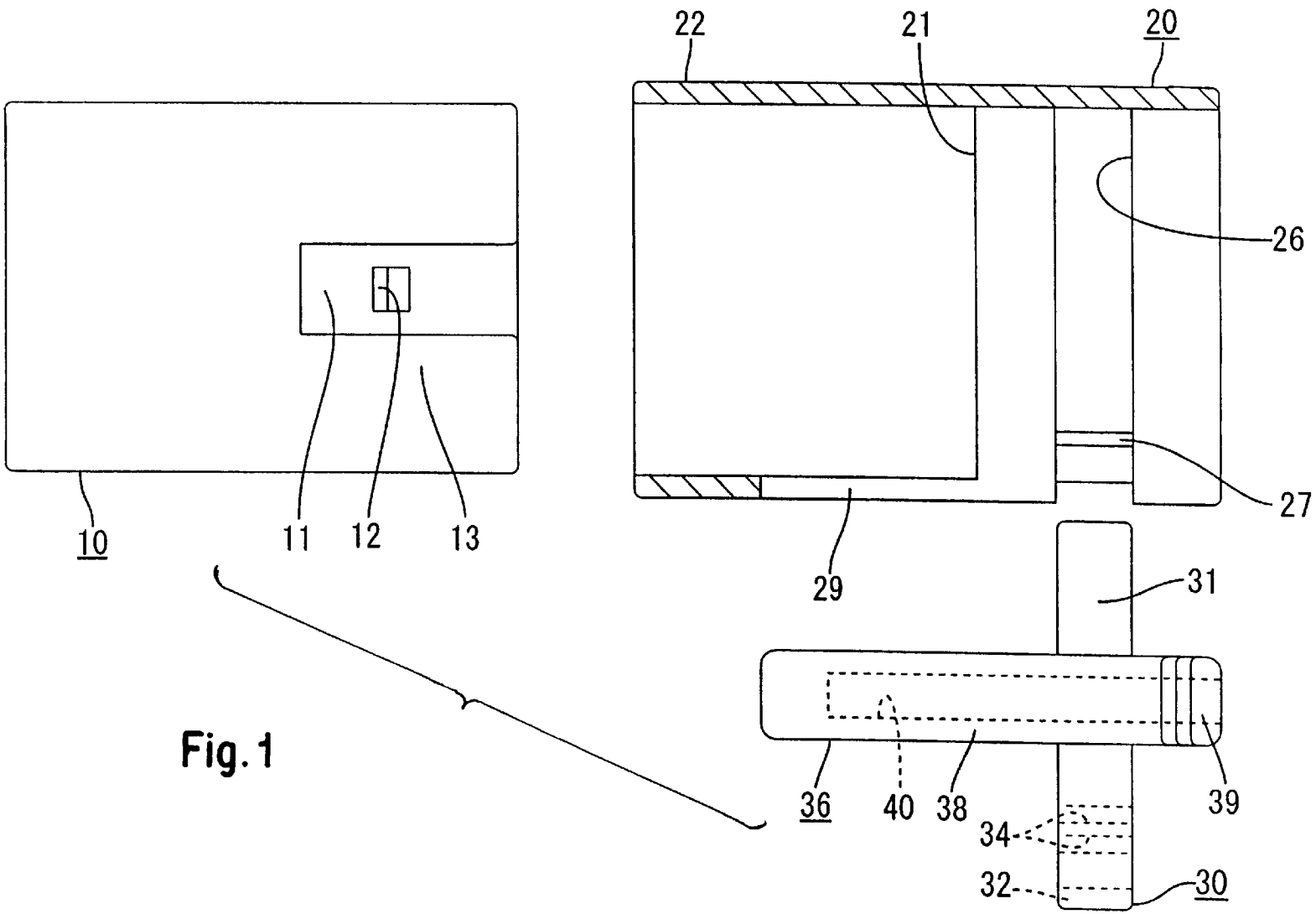
FIG. 1 is a plan cross-sectional view of a first embodiment of the present invention showing a connector in a disassembled state.
Figure 2:
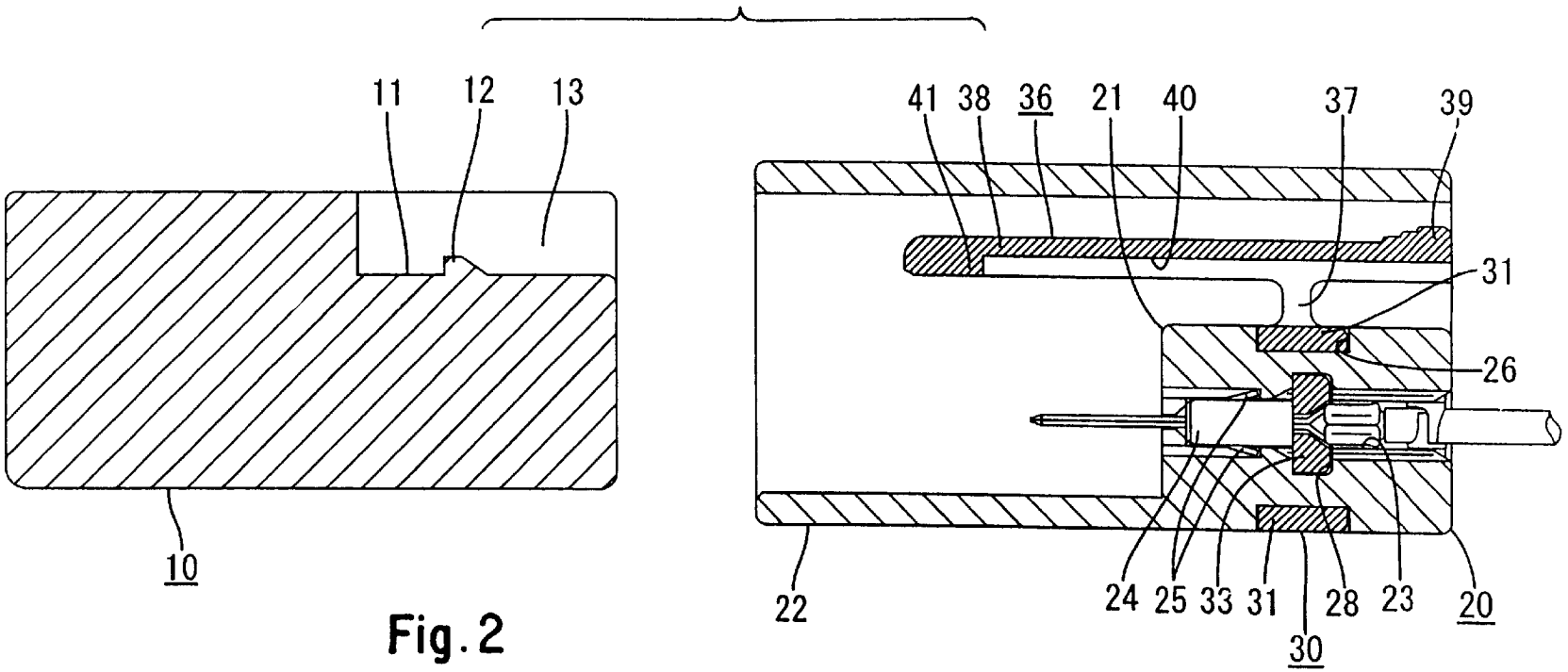
FIG. 2 is a cross-sectional view showing male and female housings.
Figure 3:
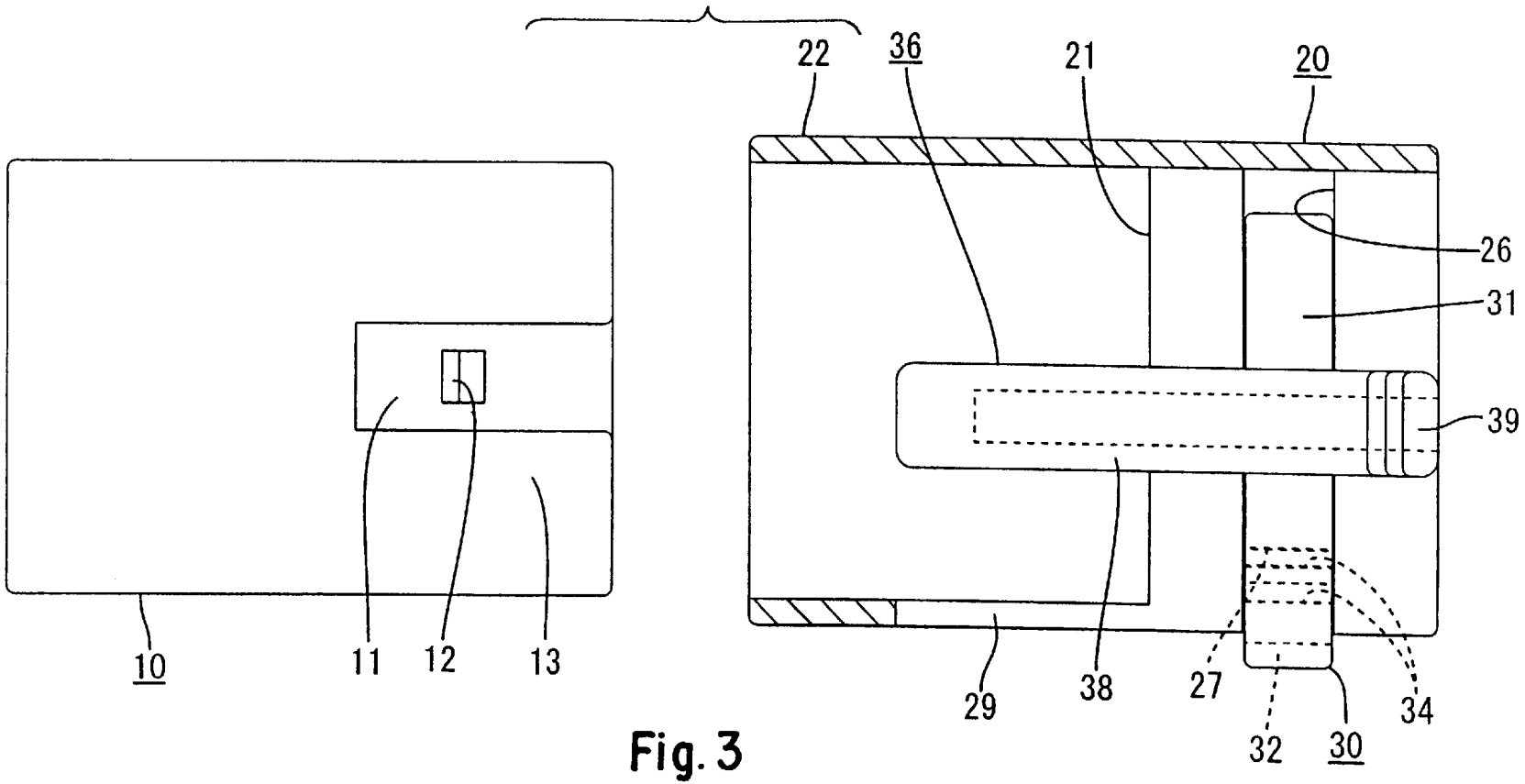
FIG. 3 is a plan cross-sectional view showing a retainer of the male housing located in a semi-retaining position.
Figure 4:
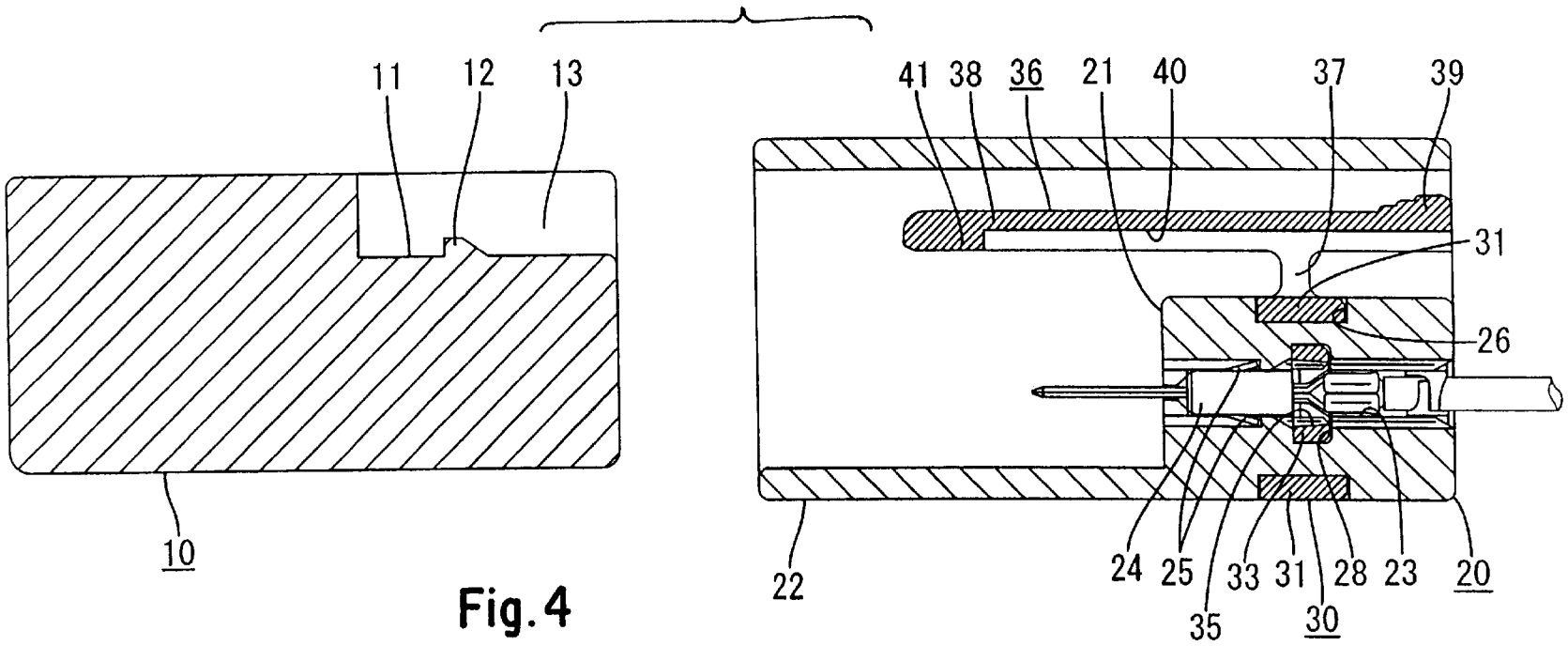
FIG. 4 is a side cross-sectional view showing the retainer of the male housing located in the semi-retaining position.

A first embodiment of the present invention is described with the aide of FIGS. 1 to 9. As shown in FIGS. 1 and 2, the present embodiment has a female connector housing 10 that fits with a male connector housing 20. The detection of a half-inserted state of a retainer 30 attached to the male housing 20 is performed at this male housing 20. Fitting face sides of the two housings 10 and 20 are considered to be the anterior sides. Furthermore, the outer side and the inner side are with reference to FIG. 1, and the upper and lower directions are with reference to FIG. 2.

A plurality of female terminal fittings (not shown) can be housed within the female housing 10. A groove 11 is formed in a concave manner in an upper face of the female housing 10. This groove 11 has a specified length and extends from approximately a central location thereof, relative to the widthwise direction, to an anterior edge thereof. A locking arm 36 in the male housing 20 can enter this groove 11. The width of the groove 11 is approximately the same as the width of the locking arm 36. A locking protrusion 12, which engages with the locking arm 36, protrudes upwards from the groove 11. A tapered face is formed on an anterior face of the locking protrusion 12.

The male housing 20 is provided with a terminal housing member 21 which is capable of housing male terminal fittings 24, and a hood 22 which surrounds the terminal housing member 21. A plurality of cavities 23, into which the male terminal fittings 24 are inserted from the posterior, are aligned in a widthwise direction within the terminal housing member 21. Each male terminal fitting 24 is provided with metal lances 25 which engage with stepped portions formed on side faces of the cavities 23. The female housing 10 can be fitted into the hood 22 from the anterior side thereof, the female housing 10 being inserted into an anterior end of the terminal housing member 21 within a portion of this hood 22 designated as a fitting area.

A retainer attachment groove 26 is formed at an upper face, a lower face, and an outer side face of the terminal housing member 21. A channel-shaped retainer 30 is inserted into this retainer attachment groove 26 from the outer side. The retainer attachment groove 26 is located at approximately the center of the terminal housing member 21 (relative to the lengthwise direction thereof). Latching protrusions 27 protrude upwards and downwards from specified locations, in the vicinity of the outer side, of upper and lower faces of the retainer attachment groove 26. A retainer attachment hole 28, into which a retained member 33 of the retainer 30 can be inserted, opens onto the outer side of the terminal housing member 21. The retainer attachment hole 28 is formed so as to pass through, in a widthwise direction, the cavities 23 within the terminal housing member 21. An opening 29 is formed in the side face of the outer side of the hood 22, this allowing the locking arm 36 of the retainer 30 to pass therethrough.

The retainer 30 is inserted from the outer side of the male housing 20 in a direction perpendicular to the fitting direction of the two housings 10 and 20 (that is, perpendicular to the direction of insertion of the male terminal fittings 24). The retainer 30 is provided with an upper and lower pair of supporting members 31 whose outer ends are joined by a joining member 32. An inner side face of the joining member 32 has the retaining member 33 of the retainer 30 protruding therefrom in the extending direction of the supporting members 31.

Two grooves 34A,34B (FIG. 5) which are mutually aligned along a direction perpendicular to the direction of insertion of the retainer 30, are formed in an inner face of each of the two supporting members 31. When the retainer 30 is located towards the outer side, these grooves engage with the latching protrusions 27 provided in the retainer attachment groove 26 of the terminal housing member 31. This allows the retainer 30 to be maintained in two different positions relative to its direction of insertion into the male housing 20; a position towards the outer side, and a position at the inner side.

The retaining member 33 is provided with a plurality of recessed holes 35. When the retaining member 33 is in an inserted state within the retainer attachment hole 28, these recessed holes 35 join with the cavities 23.

The retainer 30 can be maintained in a semi-retaining position (at the outer side) by virtue of groove 34A, and a fully-retaining position (at the inner side) by virtue of groove 34B and can be moved between these two positions. When the retainer 30 is in the semi-retaining position (see FIG. 4), the recessed holes 35 of the retaining member 33 are located so as to be connected with the cavities 23, this allowing the male terminal fittings 24 to be inserted into these cavities 23. When the retainer 30 is located in the fully-retaining position (see FIG. 2), hole edges of the recessed holes 35 of the retaining member 33 are within the cavities 23, and the male terminal fittings 24 are retained within these cavities 23.

As shown in FIGS. 1 and 2, the locking arm 36 protrudes upwards from an upper face of the retainer 30. This locking arm 36 is located in approximately the center (relative to the widthwise direction) of the upper supporting member 31 and protrudes in an anterior-posterior direction from the retainer 30, in the fitting direction of the two housings 10 and 20. The locking arm 36 is formed in a see-saw shape, being provided with a support 37 protruding upwards from the supporting member 31, and an arm member 38 that extends in an anterior-posterior direction. The arm member 38 can be moved resiliently up or down, with the support 37 serving as its center. An operating end 39 protrudes upwards from a posterior end of the arm member 38. The locking arm 36 can be bent by pressing this operating end 39.

Figure 5:
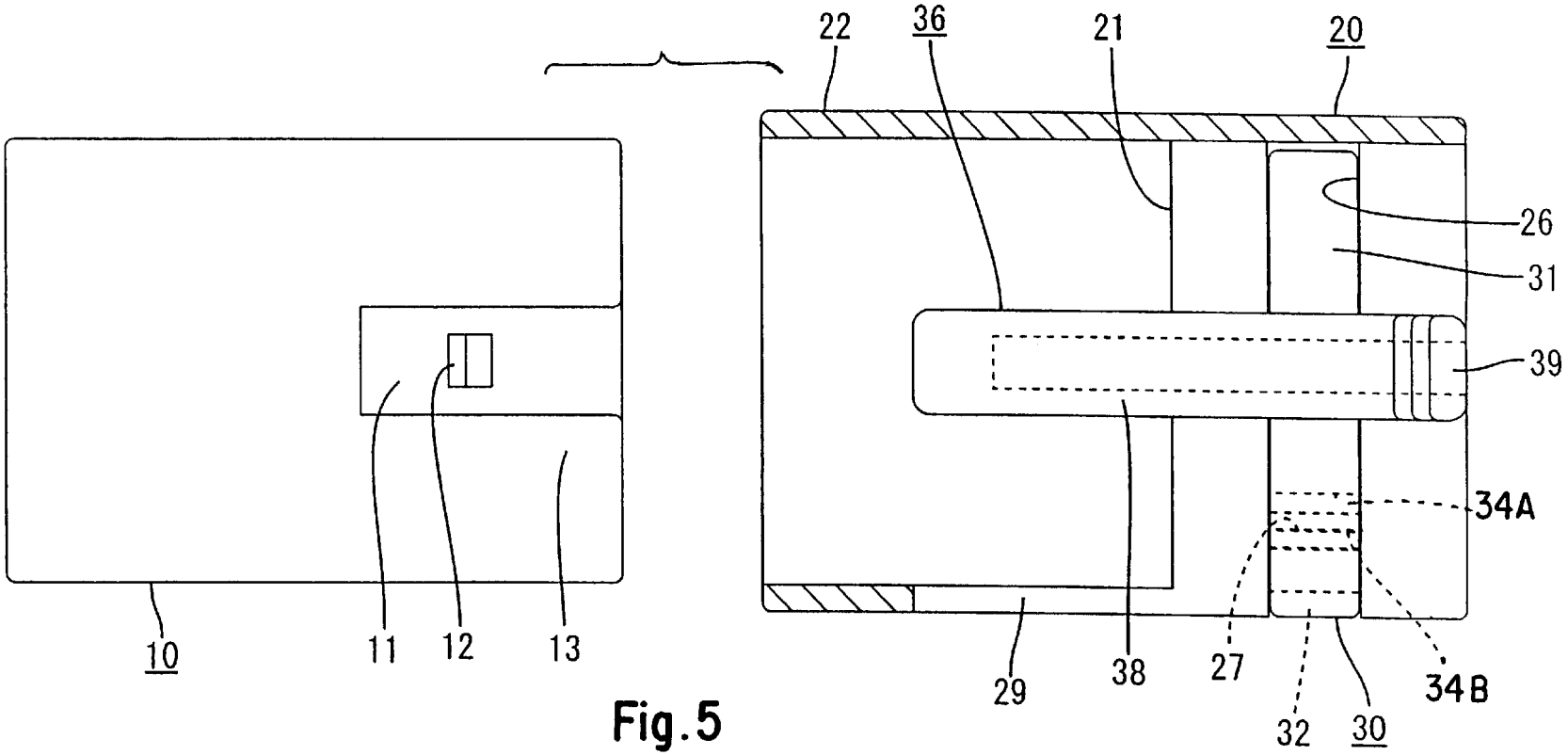
FIG. 5 is a plan cross-sectional view showing the retainer of the male housing located in a fully-retaining position.
Figure 6:
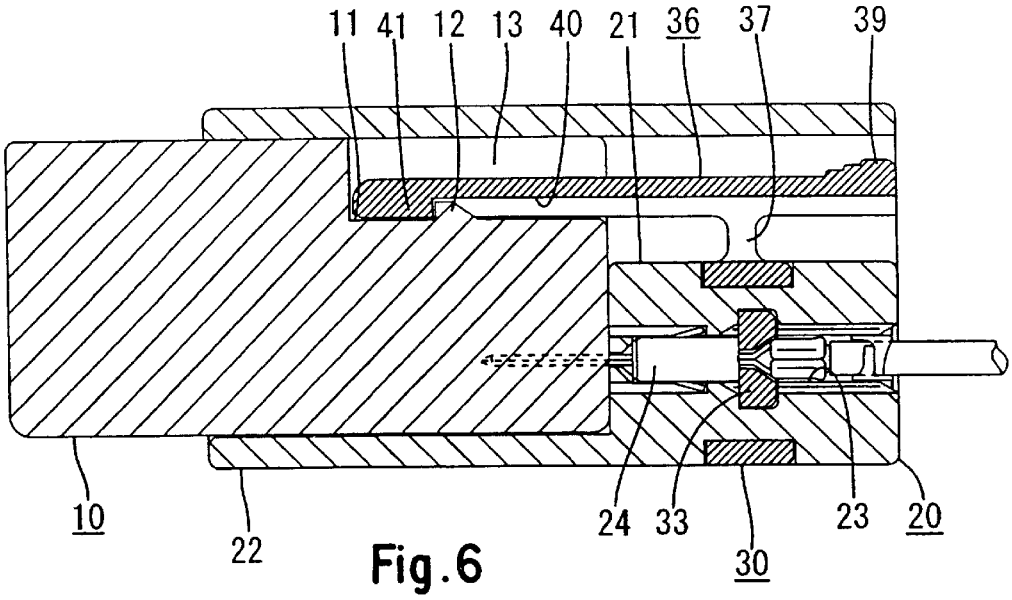
FIG. 6 is a side cross-sectional view showing the two housings in a correctly fitted state.
Figure 7:
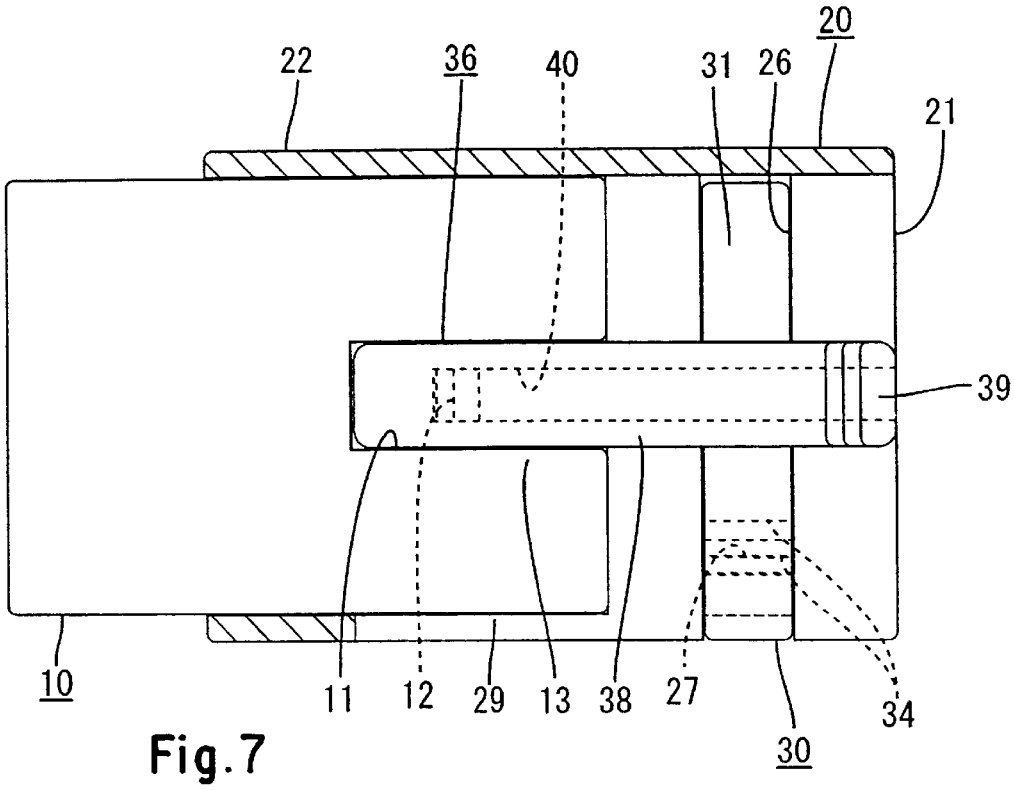
FIG. 7 is a cross-sectional view showing the two housings in the correctly fitted state.
Figure 8:
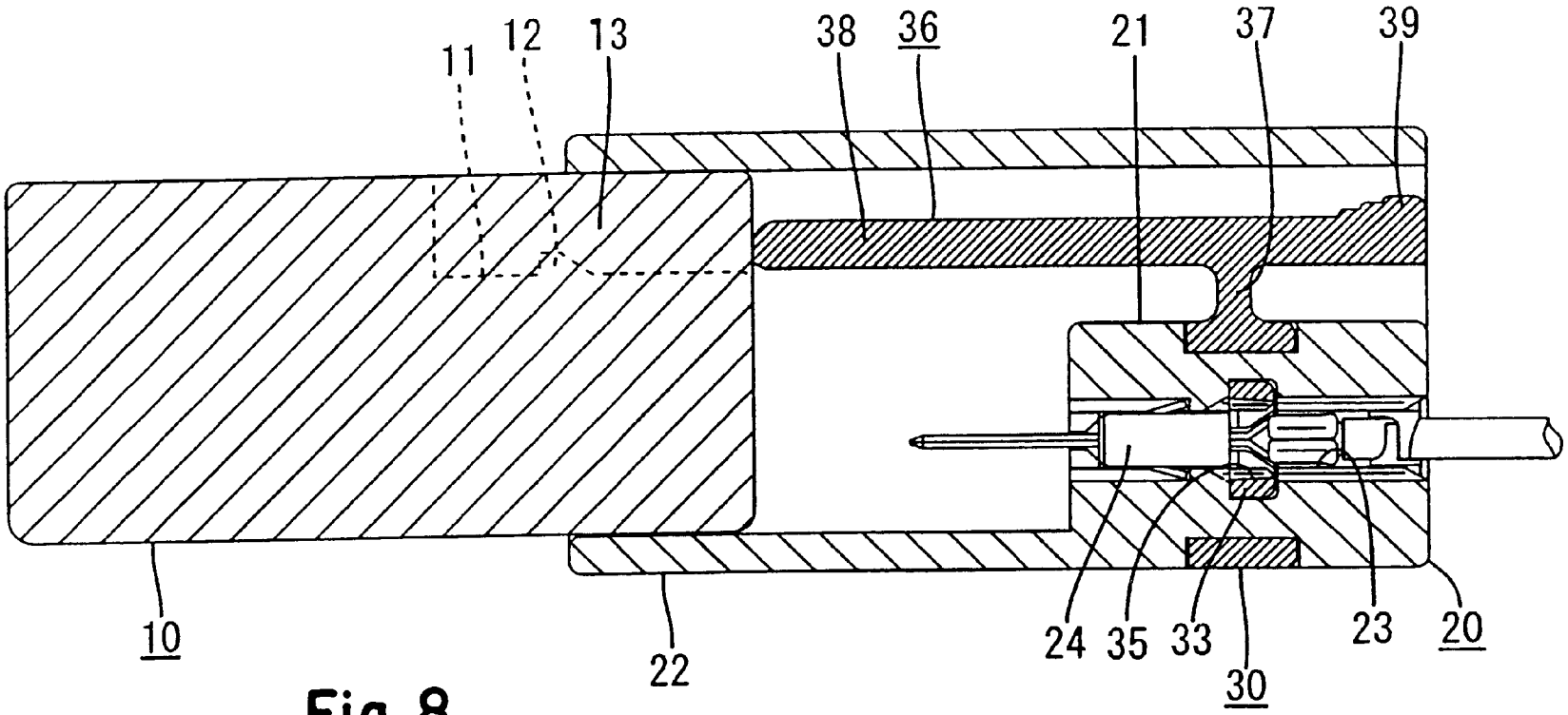
FIG. 8 is a side cross-sectional view showing the two housings in a state whereby their fitting operation is prevented.
Figure 9:
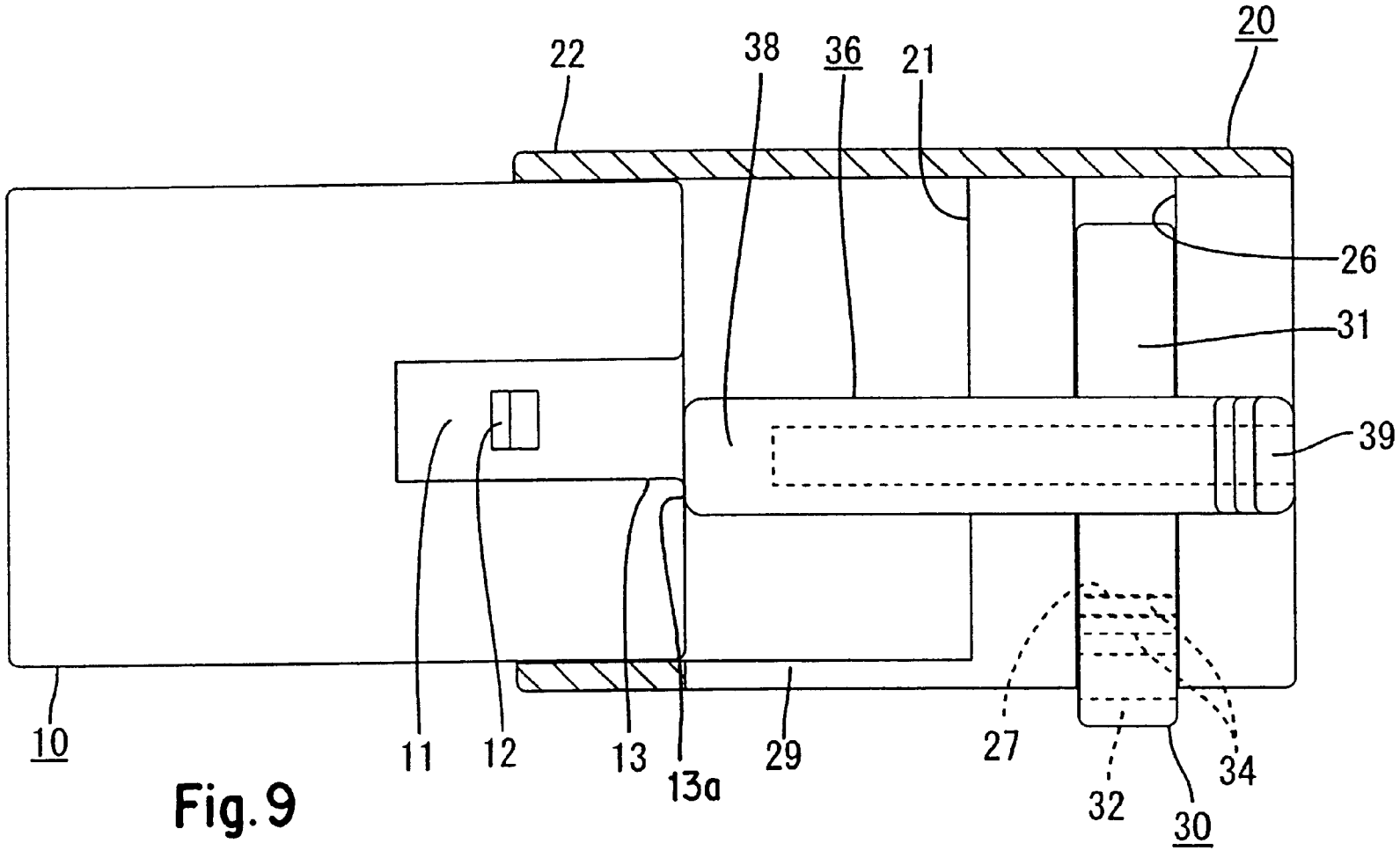
FIG. 9 is a plan cross-sectional view showing the two housings in a state whereby their fitting operation is prevented.

A concave groove 40, which has a specified width, is formed in the center, relative to the widthwise direction, of a lower face of the arm member 38. The concave groove 40 is open to the posterior of the arm member 38, and a locking claw 41 is formed at an anterior end of the concave groove 40 (that is, at an anterior end portion of the arm member 38). As shown in FIG. 5, when the retainer 30 is attached to the male housing 20 in the fully-retaining position, the arm member 38 is in alignment with the groove 11 of the female housing 10. As the two housings 10 and 20 are fitted together, the arm member 38 enters this groove 11 of the female housing 10, and the locking claw 41 engages with the locking protrusion 12 of the groove 11 (see FIG. 6). When the retainer 30 is in the fully-retaining position, the anterior end of the arm member 38 is located at a specified distance from the anterior end of the male housing 20 (this specified distance is about one fourth of the entire length of the male housing 20).

As shown in FIG. 2, the height of the groove 11 of the female housing 10 (that is, the height of a side wall 13 surrounding the groove 11) is approximately the same as the height of a ceiling face of the hood 22, and is higher than the locking arm 36. As a result, when the retainer 30 is located in the male housing 20 at a position towards the outer side relative to its fully-retaining position (the retainer 30 being located in, for example, the semi-retaining position), an anterior end face of the locking arm 36 makes contact with an anterior end face 13*a* of the side wall 13 (see FIG. 8).

The present embodiment is configured as described above. Next, the operation thereof will be described. First, the retainer 30 is inserted from the other side into the male housing 20, this attaching the retainer 30 in the semi-retaining position (see FIGS. 3 and 4). In this state, the male terminal fittings 24 are inserted into the cavities 23, then the retainer 30 is pushed into the fully-retaining position (see FIGS. 2 and 5). At this juncture, the male terminal fittings 24 are retained by the retaining member 33 of the retainer 30, this maintaining the male terminal fittings 24 in an unremovable state. At this point, an outer face side of the retainer 30 and an outer side face of the male housing 20 form an approximately unified face. Then, the two housings 10 and 20 are fitted together.

As the female housing 10 is inserted into the angular tubular portion of the hood 22 of the male housing 20, the locking arm 36 that protrudes to the anterior from the terminal housing member 21 is inserted into the groove 11. This insertion is guided by the locking arm 36 sliding side faces of the grooves 11. When the anterior end of the locking arm 36 reaches the locking protrusion 12, a claw member of the arm member 38 rises over the locking protrusion 12, and the locking arm 36 bends resiliently. When the two housings 10 and 20 are fitted to a correct depth, the locking claw 41 rises completely over the locking protrusion 12, the locking arm 36 returns to its original position, and the locking claw 41 is located to the immediate posterior of the locking protrusion 12, thereby retaining mutually opposing faces of the locking claw 41 and the locking protrusion 12 (see FIG. 6). By this means, the two housings 10 and 20 are maintained in a fitted state.

In this fitted state (see FIG. 7), the locking arm 36 is located so as to be parallel with the side wall 13 of the groove 11, the locking arm 36 being located at the inner side relative to this side wall 13. Consequently, if a pulling force is exerted on the retainer 30 in a direction of removal (that is, towards the outer side), the inner side face of the locking arm 36 is retained by the side face of the side wall 13, thereby preventing the retainer 30 from leaving the male housing 20.

It is possible that, before the two housings 10 and 20 are fitted together, a pushing force may be exerted on the retainer 30 which is insufficient to push it from the semi-retaining position to the fully-retaining position, or the pushing operation may have been forgotten. In either case, the retainer 30 will be located towards the outer side relative the fully-retaining position (that is, in the semi-retaining position shown in FIG. 3). If the two housings 10 and 20 are fitted together in this state, after the female housing 10 has been inserted for a specified depth (this being about one fourth of the entire length of the male housing 20) into the hood 22, the anterior end face 13*a* of the side wall 13 of the groove 11 will strike against the anterior end face of the locking arm 36 (see FIGS. 8 and 9), thereby preventing the two housings 10 and 20 from being fitted together. By this means, it can be detected that the retainer 30 has not reached the fully-retaining position.

In the embodiment described above, the locking arm 36, which is formed as one component with the retainer 30, protrudes into the fitting area into which the female housing 10 is inserted. Consequently, the locking arm 36 can make contact with the female housing 10. This allows one to detect the half-inserted state of the retainer 30, which is attached to the male housing 20 at a location outwards and to the posterior of the fitting area.

Furthermore, the locking arm 36, which allows one to detect the half-inserted state of the retainer 30, also functions as a configuration for locking the two housings 10 and 20 in a fitted state. Consequently, the configuration of the connector is simplified.

A second embodiment of the present invention is described below with the aid of FIGS. 10 to 16. This embodiment describes the detection of a half-inserted state of a retainer 63 provided on a female housing 60. Furthermore, the outer side and the inner side are with reference to FIG. 10, and the upper and lower directions are with reference to FIG. 11.

Figure 10:
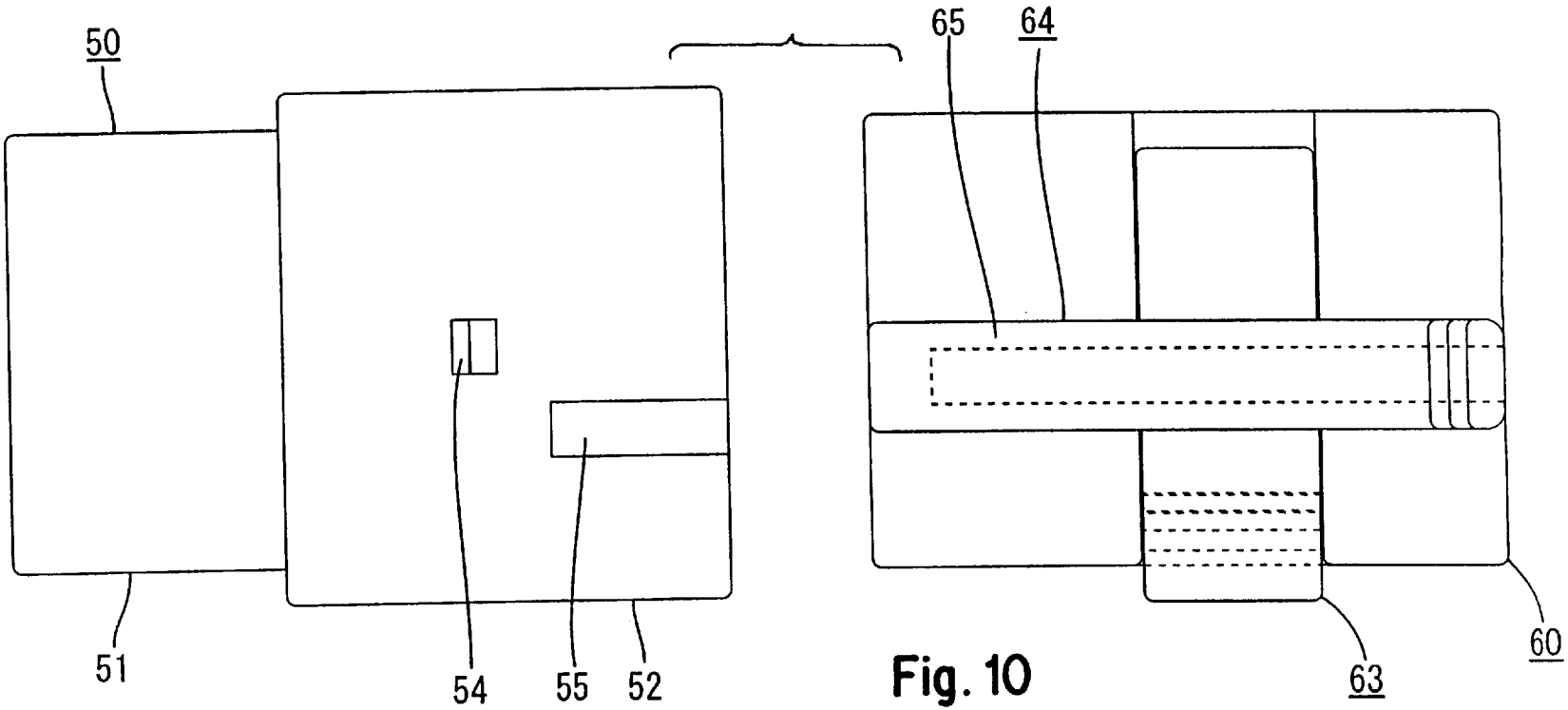
FIG. 10 is a plan view of a second embodiment of the present invention showing a retained of a female housing located in a semi-retaining position.
Figure 11:
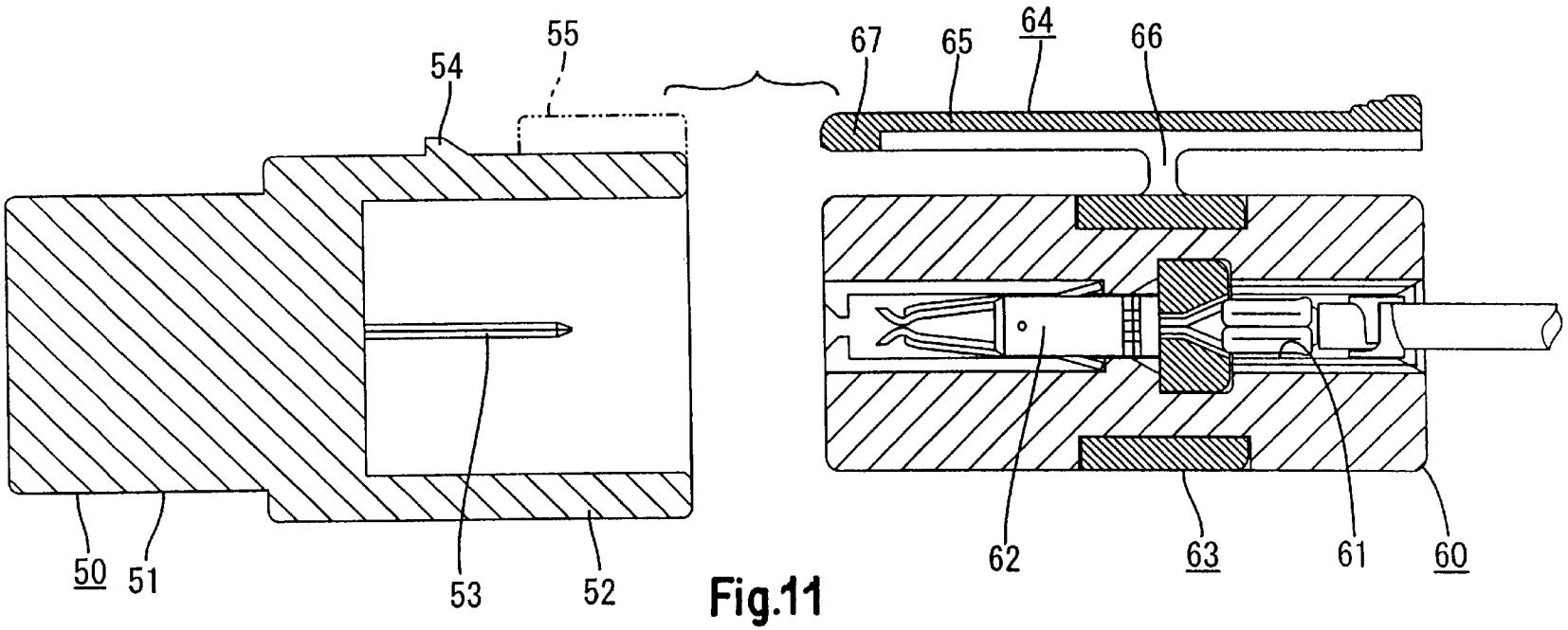
FIG. 11 is a side cross-sectional view showing the retainer of the female housing located in a fully-retaining position.

As shown in FIGS. 10 and 11, a male housing 50 is provided with a terminal housing member 51 capable of housing male terminal fittings 53, and a tubular-shaped hood 52 protrudes towards the anterior from the terminal housing member 51. The female housing 60 can be fitted into the hood 52. A locking protrusion 54 protrudes upwards from the center of an upper face of the hood 52. A regulating member 55 (to be explained) protrudes upwards from a location towards the outer side relative to the locking protrusion 54.

A plurality of cavities 61, into which female terminal fittings 62 can be inserted, are aligned in a widthwise direction within the female housing 60. The configuration of the retainer 63, the configuration whereby the retainer 63 is attached to the female housing 60, the configuration whereby the retainer 63 retains the female terminal fittings 62, and the configuration of a locking arm 64 are the same as in the first embodiment, and the functions thereof are the same. Consequently, an explanation thereof is omitted.

An arm member 65 of the locking arm 64, which is formed in a unified manner with the retainer 63, has a length approximately the same as the length of the female housing 60. When the retainer 63 is in an attached state with the female housing 60, an anterior end face of the locking arm 64 forms an approximately unified face with an anterior end face of the female housing 60. As shown in FIG. 11, a support 66 of the locking arm 64 has a height approximately the same as the thickness as the hood 52 of the male housing 50. When the female housing 60 is to be inserted into the hood 52 of the male housing 50, the locking arm 64 is located at an upper face of the hood 52.

Figure 12:
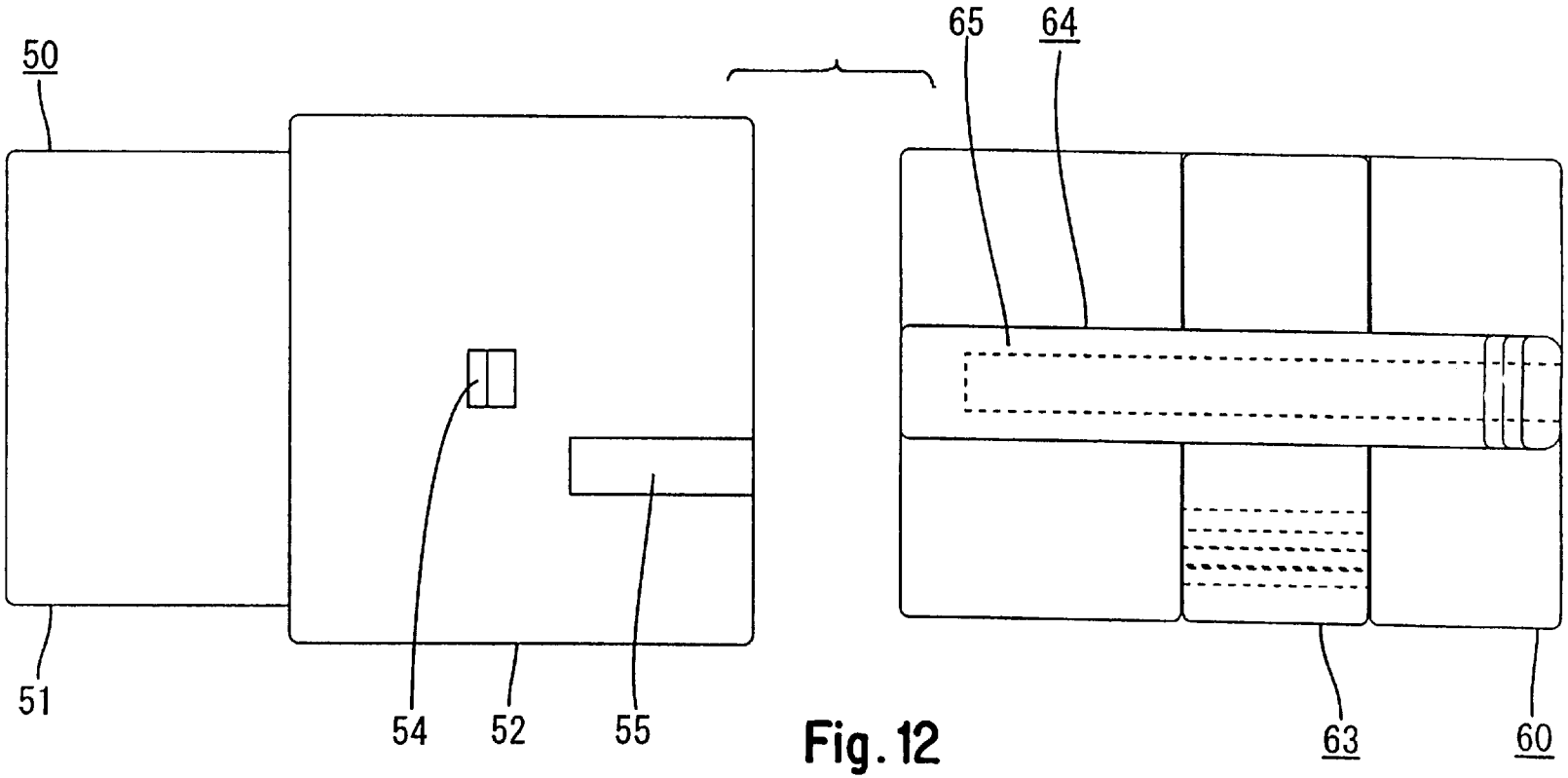
FIG. 12 is a plan view showing the retainer of the female housing located in a fully-retaining position.
Figure 13:
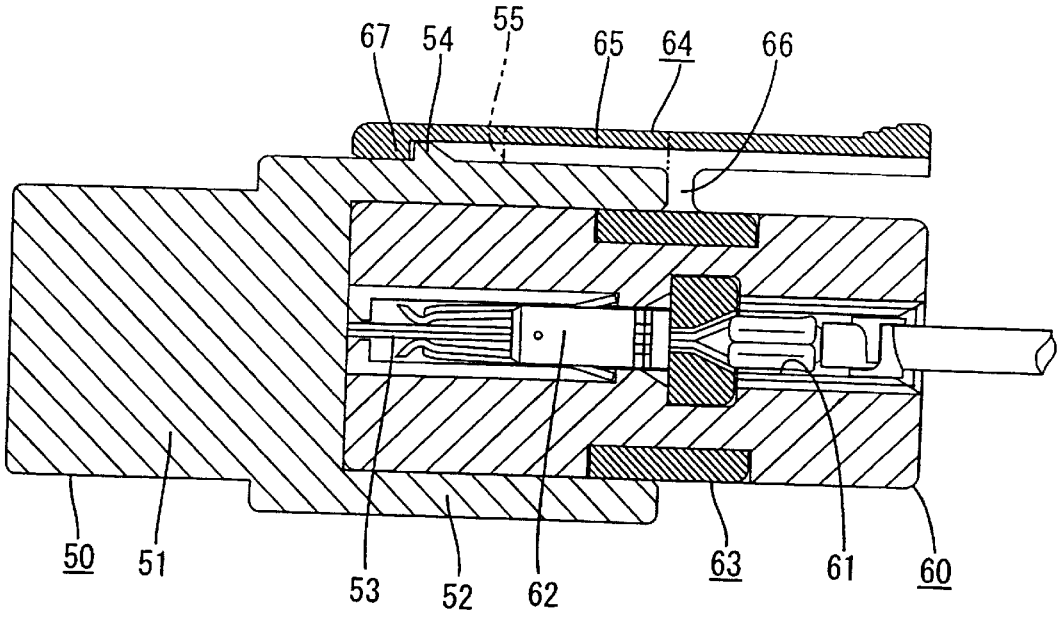
FIG. 13 is a side cross-sectional view showing two housings in a correctly fitted state.
Figure 14:
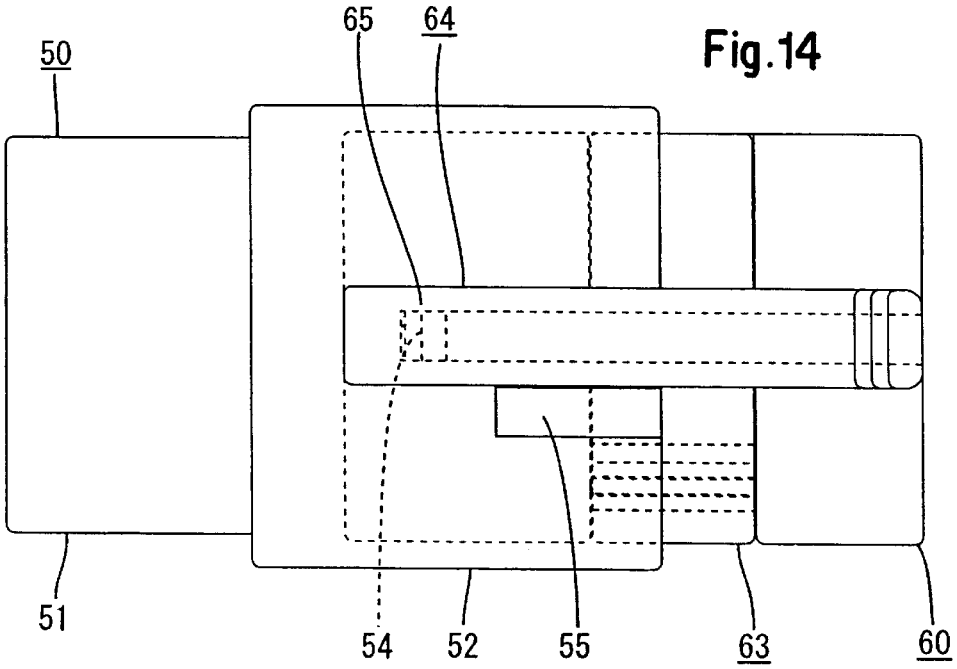
FIG. 14 is a plan view showing the two housings in the correctly fitted state.

Now the regulating member 55 of the male housing 50 will be explained. As shown in FIG. 10, the regulating member 55 extends from an anterior end of the hood 52 along approximately one fourth of the entire length of the male housing 50. As shown in FIG. 12, the regulating member 55, which is located along the widthwise direction of the hood 52, is positioned towards the outer side relative to the locking arm 64 of the retainer 63 (this retainer 63 being attached to the female housing 60 in the fully-retaining position).

The present embodiment is configured as described above. Next, the operation thereof will be described. The female terminal fittings 62 are inserted into the cavities 61 while the retainer 63 is attached to the female housing 60 in the semi-retaining position (see FIG. 10). Then the retainer 63 is pushed in to the fully-retaining position (see FIGS. 11 and 12). At this juncture, an outer circumference face of the retainer 63 forms an approximately unified face with an outer circumference face of the female housing 60.

Next, the female housing 60 is fitted into the hood 52 of the male housing 50, the locking arm 64 is inserted to the inner side of the regulating member 55 on the upper face of the hood 52, an inner side face of this regulating member 55 making sliding contact with an outer side face of the locking arm 64 and thereby guiding the movement thereof as it is inserted. Then the locking arm 64 bends resiliently as it rises over the locking protrusion 54. When the two housings 50 and 60 are fitted to a correct depth, a locking claw 67 of the locking arm 64 rises over the locking protrusion 54, the locking arm 64 returns resiliently to its original position, and the locking claw 67 is retained by the locking protrusion 54, thereby maintaining the two housings 50 and 60 in a fitted state (see FIG. 13). At this juncture, the regulating member 55 adjoins the locking arm 64 in a parallel manner, the regulating member 55 being located to the outer side thereof (see FIG. 14). An outer side face of the locking arm 64 is engaged with an inner side face of the regulating member 55. Consequently, even if a pulling force is exerted on the retainer 63 to move it towards the outer side, the retainer 63 will be prevented from leaving the female housing 60.

Figure 15:
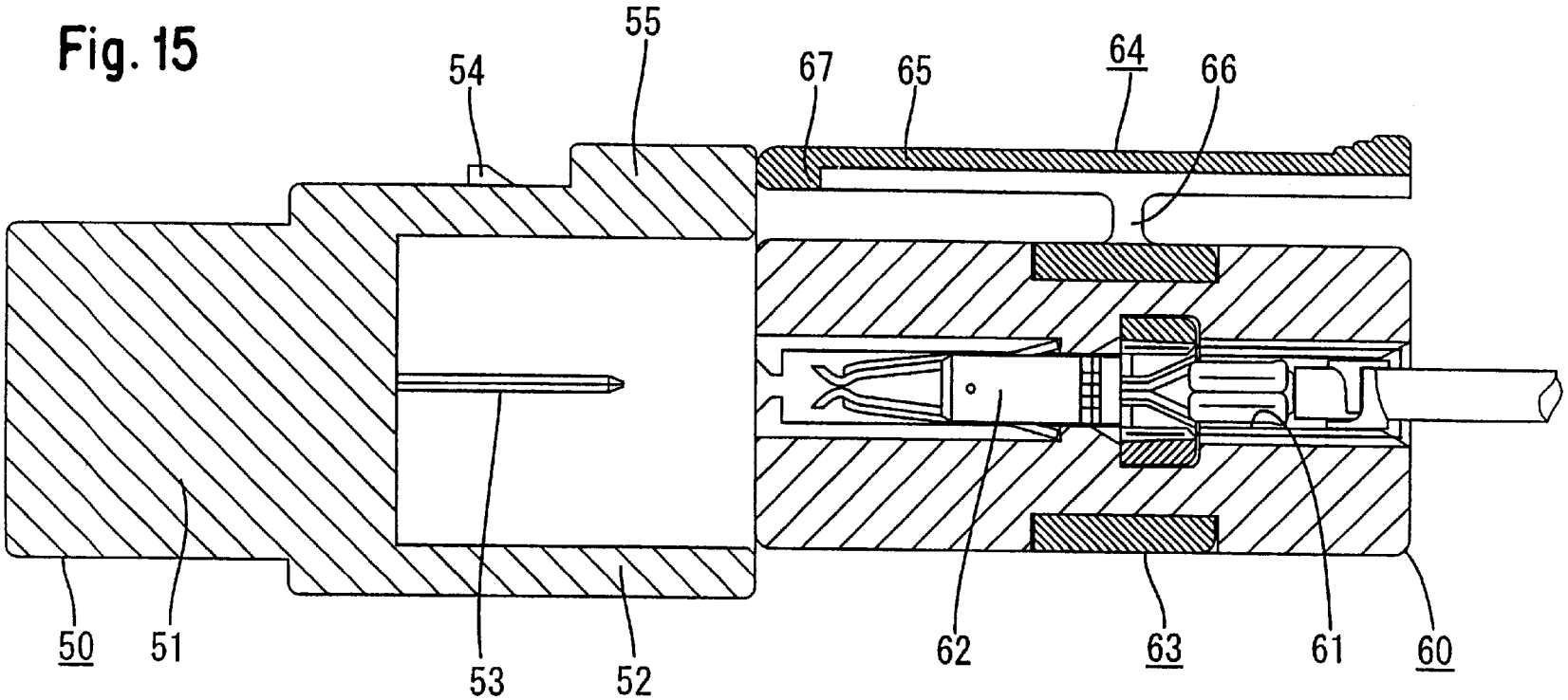
FIG. 15 is a side cross-sectional view showing the two housings in a state whereby their fitting operation is prevented.
Figure 16:
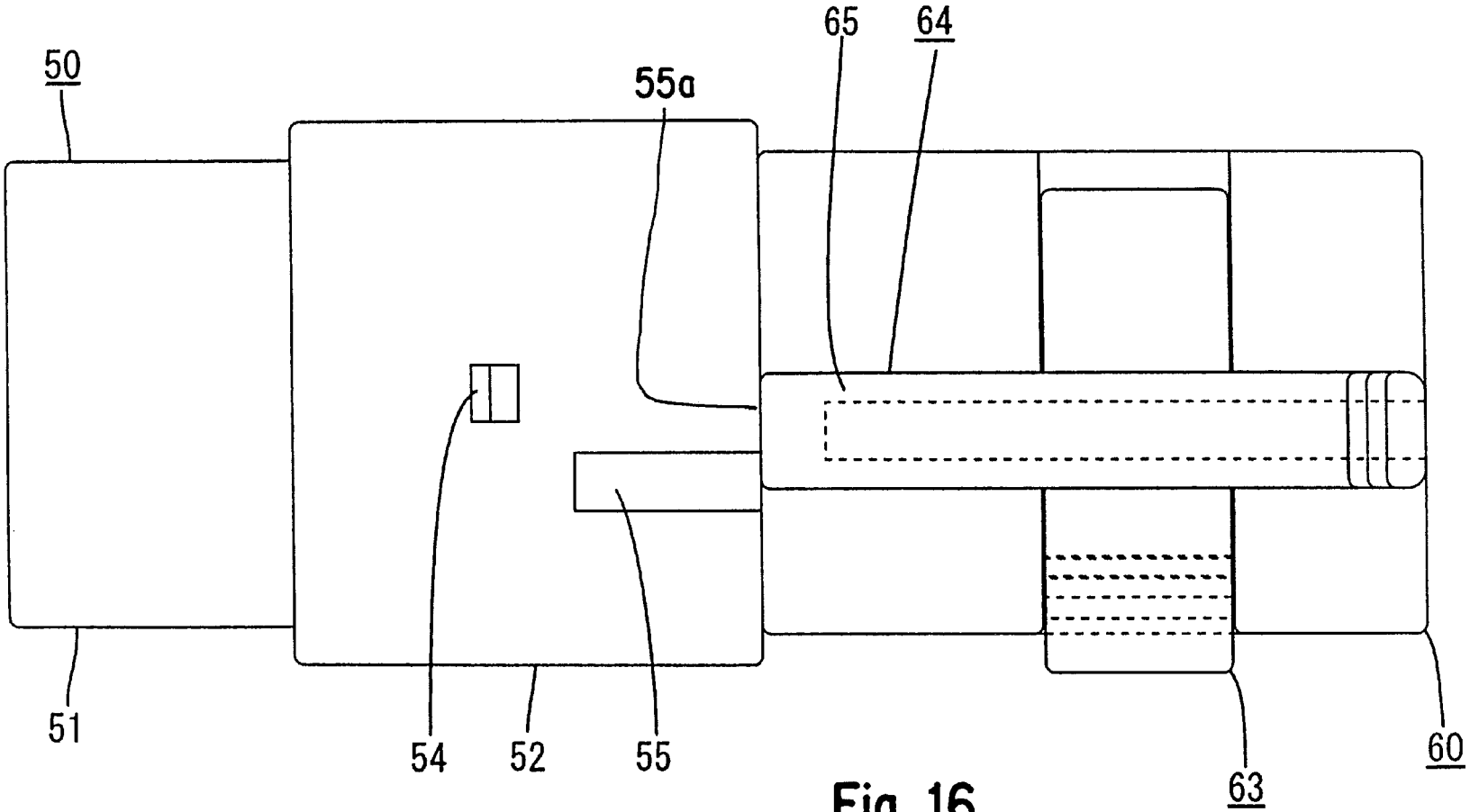
FIG. 16 is a plan view showing the two housings in a state whereby their fitting operation is prevented.

It is possible that the two housings 50 and 60 may be fitted together while the retainer 50 is located towards the outer side relative to the fully-retaining position (that it, in the semi-retaining position shown in FIG. 10). In that case, as shown in FIGS. 15 and 16, an anterior-end face of the locking arm 64 will strike against an anterior-end face 55*a* of the regulating member 55 immediately before the female housing 60 is inserted into the hood 52 of the male housing 50, thereby preventing the two housings 50 and 60 from being fitted together. By this means, it can be detected that the retainer 63 is in the semi-retaining position.

In the embodiment described above, the locking arm 64 protrudes further towards the anterior than the retainer 63. Consequently, the half-inserted state of the retainer 63 can be detected at the stage when the fitting operation begins, and the operability of joining the connector is improved.

Furthermore, the present invention is not limited to the embodiments described above with the aid of figures. For example, the possibilities described below also lie within the technical range of the present invention. In addition, the present invention may be embodied in various other ways without deviating from the scope thereof.

(1) In the embodiments described above, the half-inserted state is detected of a retainer that is attached to either the male or the female housing. However, the present invention is also suitable for the case whereby the half-inserted state is detected of a retainer of both the male and female housings. That is, retainers are inserted into the male and female housings respectively from opposite sides, and regulating members are provided on both housings at locations towards the outer side relative to the direction of insertion of each retainer into its housing.

(2) In the embodiments described above, the locking arm also serves as the configuration for detecting the half-inserted state of the retainer. However, the locking arm may equally well have only a locking function, and a detecting member may be provided separately.

(3) In the embodiments described above, the projection and channel are both rectangular. However other shapes are possible provided that the channel can regulate movement of the retainer. A taper or pointed shape is for example possible.

(4) As described, the projection and channel are close fitting, but the channel needs to be close fitting only on the side preventing withdrawal of the retainer—the other side of the channel need not be close fitting provided insertion of the retainer is stopped by other means.

(5) A retainer may of course be provided in either or both male and female housings.

What is claimed is:

1. A connector comprising two connector housings engageable along a fitting direction, to a fully fitted condition, said connector housings having respective terminals therein, and a retainer insertable in one of said housings at right angles to said fitting direction to a final position, said retainer engaging a locking protrusion on said one of said housings and said terminals in said one of said housings being retained when said retainer is in said final position, said retainer including a projection extending in the fitting direction towards the other of said housings, and said other of said housing having a regulating member for contact with said projection, said regulating member adapted to prevent movement of said housings to the fully fitted condition when said retainer is not in the final position and to prevent movement of the retainer in a direction perpendicular to the fitting direction when the housings are in said fully fitted condition.

2. A connector according to claim 1 wherein in the final position of said retainer, and in the fully fitted condition of said housings, said regulating member is at the side of said projection, thereby preventing withdrawal of the retainer from the final position.

3. A connector according to claim 2 wherein said regulating member is defined by a channel in the exterior of said other of said housings.

4. A connector according to claim 1 wherein said regulating member comprises an anterior end wall adjacent a channel in an exterior of said other one of said housings, said end wall being adapted to abut said projection in the event that said retainer is not in the final position.

5. A connector according to claim 2 wherein said regulating member comprises an anterior end wall adjacent a channel in an exterior of said other one of said housings, said end wall being adapted to abut said projection in the event that said retainer is not in the final position.

6. A connector according to claim 3 wherein said projection and channel have a corresponding shape, and wherein said projection is substantially rectangular in plan, and said channel is rectangular in plan.

7. A connector according to claim 4 wherein said projection and channel have a corresponding shape, and wherein said projection is substantially rectangular in plan, and said channel is rectangular in plan.

8. A connector according to claim 6 wherein said projection is a close fit in said channel and wherein said projection is below an upper edge of said channel is the fully fitted condition.

9. A connector according to claim 7 wherein said projection is a close fit in said channel and wherein said projection is below an upper edge of said channel is the fully fitted condition.

10. A connector according to claim 1 wherein said regulating member comprises a protrusion upstanding from said other one of said housings.

11. A connector according to claim 1 wherein said projection comprises a latching arm engageable with an abutment of said other one of said housings to retain said housings in the fully fitted condition.

12. A connector according to claim 11 wherein said latching arm is bendable.

13. A connector according to claim 12 wherein said retainer is cruciform in plan, one arm thereof being for engagement with said regulating member and said abutment, and an opposite arm comprising an operating member for bending said one arm.

14. A connector according to claim 1 and further including releasable retention means operable between said retainer and said one of said housings, said retention means defining an insertion depth of said retainer corresponding to said final position.

15. A connector according to claim 1 and further including retaining means operable between said retainer and said one of said housings, said retaining means defining an insertion depth of said retainer corresponding to an initial position in which the terminals in said one of said housings are not retained.

16. A connector according to claim 1 wherein said retainer is insertable in the other of said housings and adapted to prevent movement of said housings to the fully fitted condition in the event that the retainer of said other housings is not in the final position.

17. A connector comprising two connector housings engageable along a fitting direction, to a fully fitted condition, said connector housings having respective terminals therein, and a retainer insertable in one of said housings at right to said fitting direction to a final position, said retainer engaging a locking protrusion on said one of said housings and said terminals in said one of said housings being retained when said retainer is in said final position, said retainer including a projection extending in the fitting direction towards the other of said housings, and the other of said housings having a regulating member for contact with said projection, said regulating member adapted to prevent movement of said housings to the fully fitted condition when said retainer is not in said final position and to prevent movement of the retainer in a direction perpendicular to the fitting direction when the housings are in said fully fitted condition, said regulating member comprising an upstanding projection of the other one of said housings and being at a side of said retainer in said fully fitted condition of said housings.

* * * * *

UNITED STATES PATENT AND TRADEMARK OFFICE

CERTIFICATE OF CORRECTION

PATENT NO. : 6,450,840 B2
DATED : September 17, 2002
INVENTOR(S) : Hideto Nakamura It is certified that error appears in the above-identified patent and that said Letters Patent is hereby corrected as shown below:

Column 8,
Line 6, replace “housing” with -- housings --.

Column 9,
Line 8, replace “housings” with -- housing --.

Signed and Sealed this

Twenty-fifth Day of February, 2003

JAMES E. ROGAN
*Director of the United States Patent and Trademark Office*